US006368259B1

(12) United States Patent
Liao et al.

(10) Patent No.: US 6,368,259 B1
(45) Date of Patent: Apr. 9, 2002

(54) DAMPING ASSEMBLY FOR AN EXERCISER

(76) Inventors: Lung-An Liao, No. 35, Alley 5, Lane 182, Sec. 2, Wenhua Rd., Panchiao City, Taipei Hsien (TW); Chien-Nan Wu, No. 30, Lane 124, Tsung 2 St., Yungkang City, Tainan Hsien (TW)

( * ) Notice: Subject to any disclaimer, the term of this patent is extended or adjusted under 35 U.S.C. 154(b) by 0 days.

(21) Appl. No.: 09/740,675

(22) Filed: Dec. 18, 2000

(51) Int. Cl.[7] ..... A63B 21/22
(52) U.S. Cl. ..... 482/132; 482/907; 482/121
(58) Field of Search ..... 482/904, 72, 132, 482/907, 127, 126, 121, 120, 114–116

(56) References Cited

U.S. PATENT DOCUMENTS 1,983,911 A * 12/1934 Luppert ..... 482/127
3,704,886 A * 12/1972 Kay et al. ..... 482/127
4,625,962 A * 12/1986 Street ..... 482/127
5,226,867 A * 7/1993 Beal ..... 482/127
6,017,296 A * 1/2000 Tang et al. ..... 482/132

* cited by examiner

*Primary Examiner*—Jerome W. Donnelly
(74) *Attorney, Agent, or Firm*—Kolisch Hartwell Dickinson McCormack & Heuser

(57) ABSTRACT

A damping assembly has a bracket, a damping wheel, a torsion spring, at least one pair of rotating wheels and a strap. The damping wheel is rotatably mounted in the bracket. The torsion spring is arranged between the bracket and the damping wheel to provide a torsion force to the damping wheel. A cord wound around each rotating wheel of one pair of the rotating wheels. The strap is connected between damping wheel and the secondary axle with the rotating wheels attached to the cords. By such an arrangement, the damping assembly can be used with a roller exerciser or a chest exerciser with little additional structure. The use of the damping assembly becomes more versatile. The cost for manufacturing different types of exercisers is decreased.

13 Claims, 6 Drawing Sheets

DAMPING ASSEMBLY FOR AN EXERCISER

BACKGROUND OF THE INVENTION

1. Field of the Invention

The present invention relates to a damping assembly, and more particularly to a damping assembly that can be used with different exercisers.

2. Description of Related Art

Personal exercisers are used in houses for a user to exercise or condition his or her body. The conventional personal exerciser is usually a simple structure. For example, a conventional roller exerciser comprises a handlebar and a rotating wheel rotatably mounted on the handlebar. The user holds the handlebar to extend or curve his or her body on the floor, such that the abdominal muscles of the user are exercised and conditioned. However, the conventional home exerciser usually has only one function to exercise or condition an area of the body. The use of the conventional exerciser is limited and not versatile. For the manufacturer, different structural components must be manufactured to assemble an exerciser. This will increase the cost of manufacturing the conventional exerciser.

To overcome the shortcomings, the present invention provides a damping assembly that is able to be adapted to different exercisers to mitigate or obviate the aforementioned problems.

SUMMARY OF THE INVENTION

The main objective of the invention is to provide a damping assembly that can be used with different types of exercisers. The damping assembly has a bracket, a damping wheel, a torsion spring, at least one pair of rotating wheels and a strap. The damping wheel is rotatably mounted in the bracket. The torsion spring is arranged between the bracket and the damping wheel to provide a torsion force to the damping wheel. A cord is wound each rotating wheel of one pair of the rotating heels. The strap is connected between the damping wheel and the secondary axle with the rotating wheels attached to the cords. With such a damping assembly, the damping assembly can be used with a roller exerciser or a chest exerciser. The use of the exerciser becomes more versatile, and the cost for manufacturing different types of exercisers is decreased.

Other objects, advantages and novel features of the invention will become more apparent from the following detailed description when taken in conjunction with the accompanying drawings.

DETAILED DESCRIPTION OF PREFERRED EMBODIMENT

Figure 1:
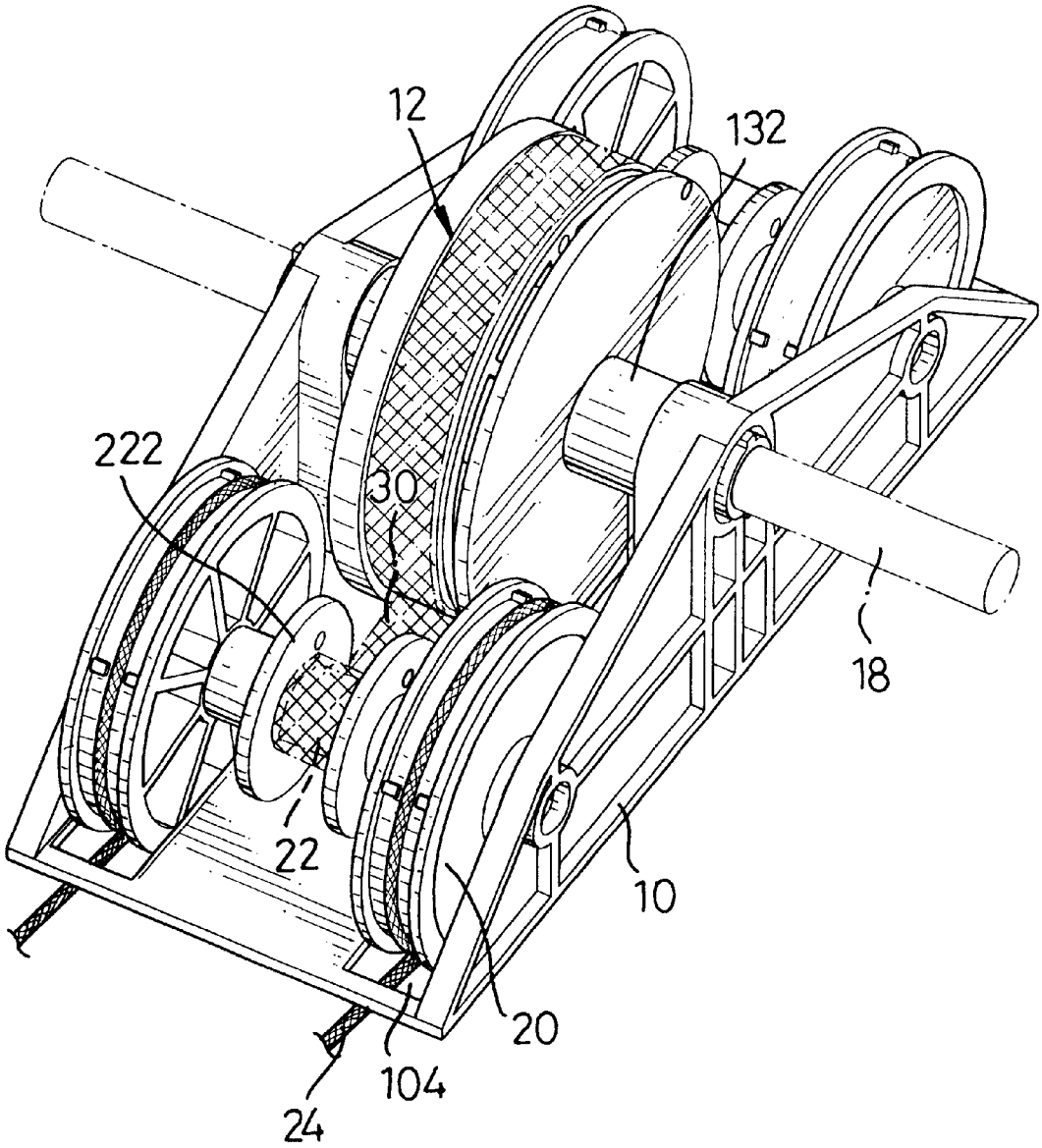
FIG. 1 is a perspective view of a damping assembly in accordance with the present invention in a roller exerciser.
Figure 2:
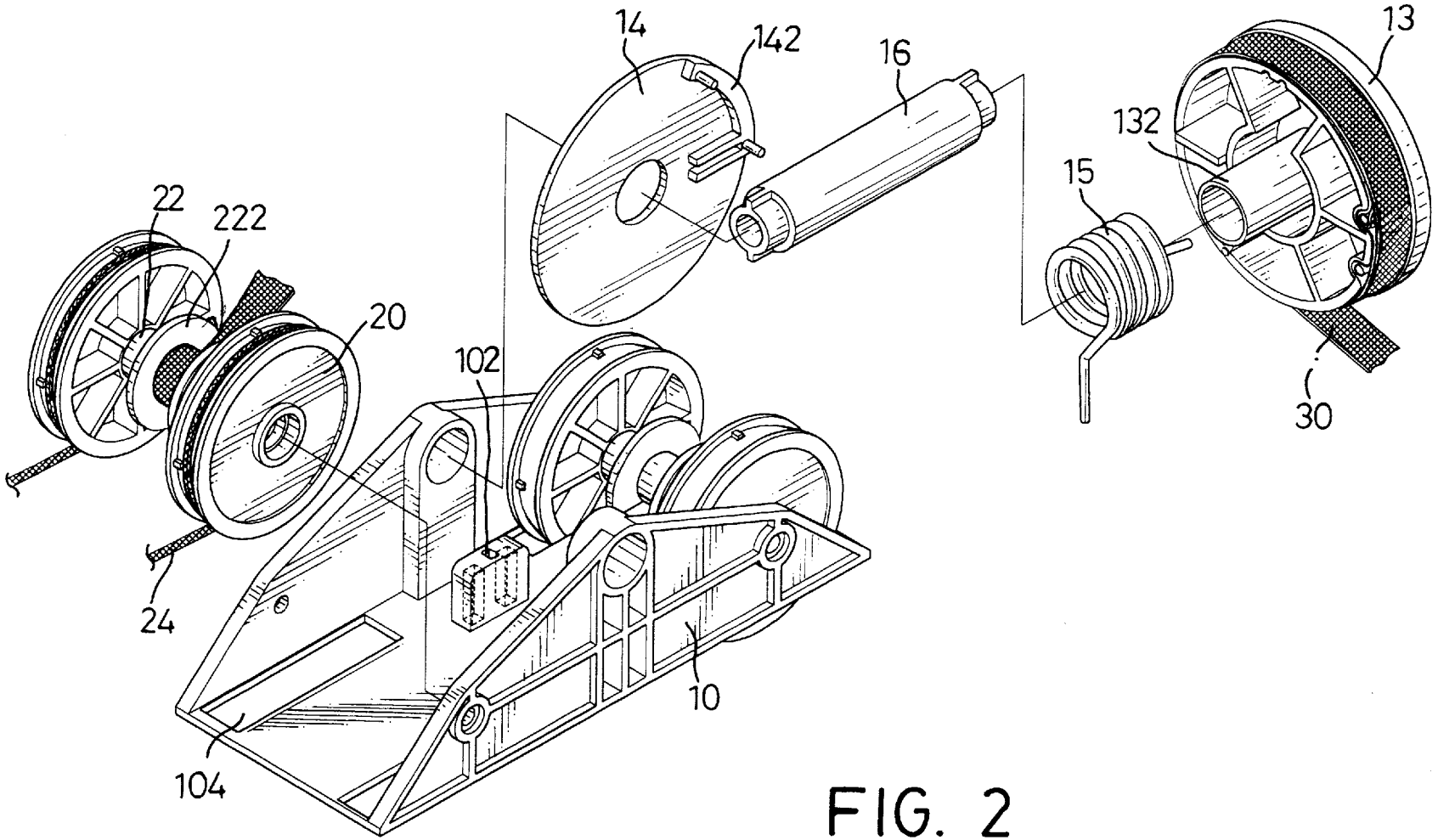
FIG. 2 is an exploded perspective view of the damping assembly in FIG. 1.
Figure 3:
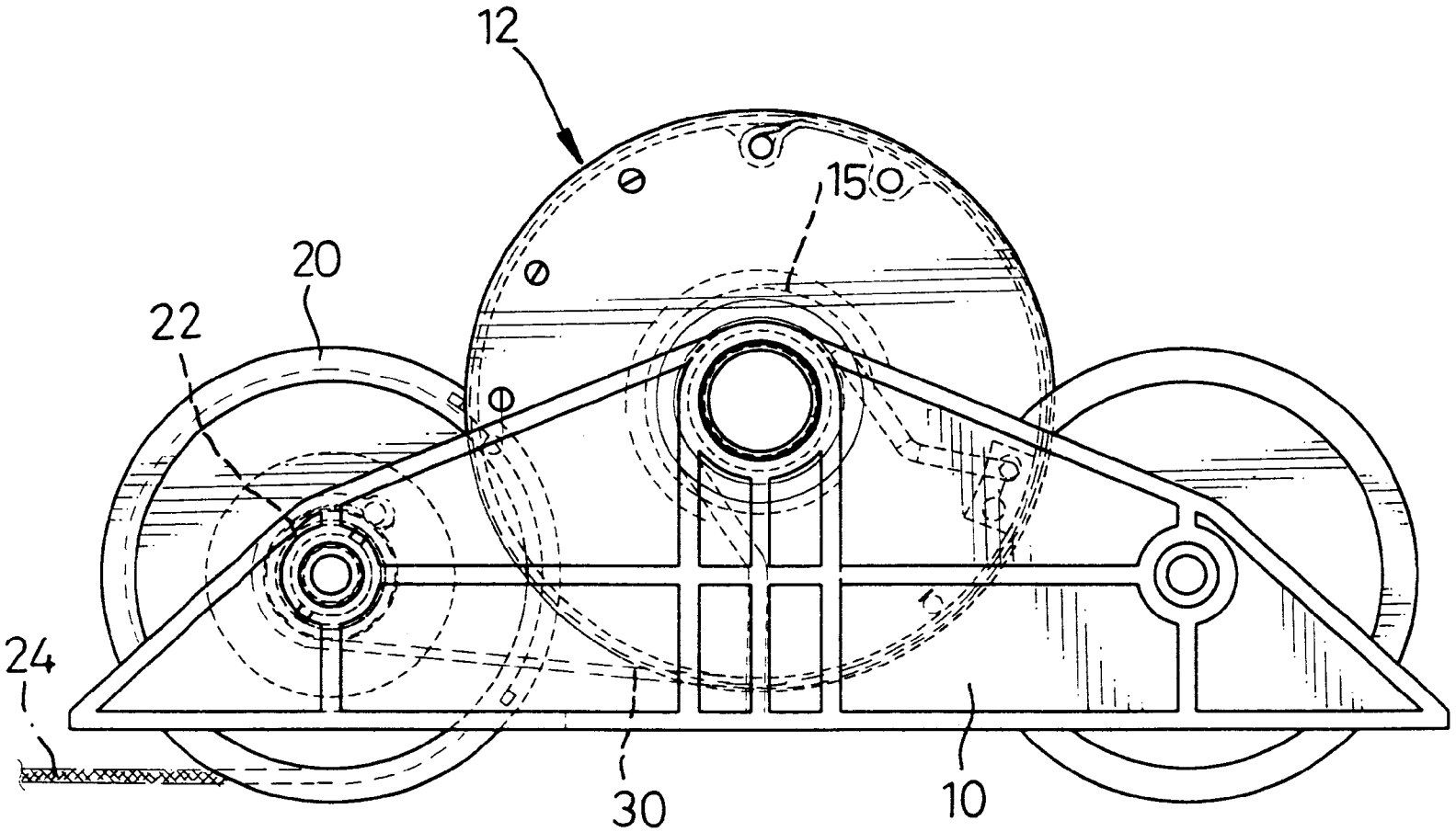
FIG. 3 is a side plan view of the damping assembly in FIG. 1.
Figure 4:
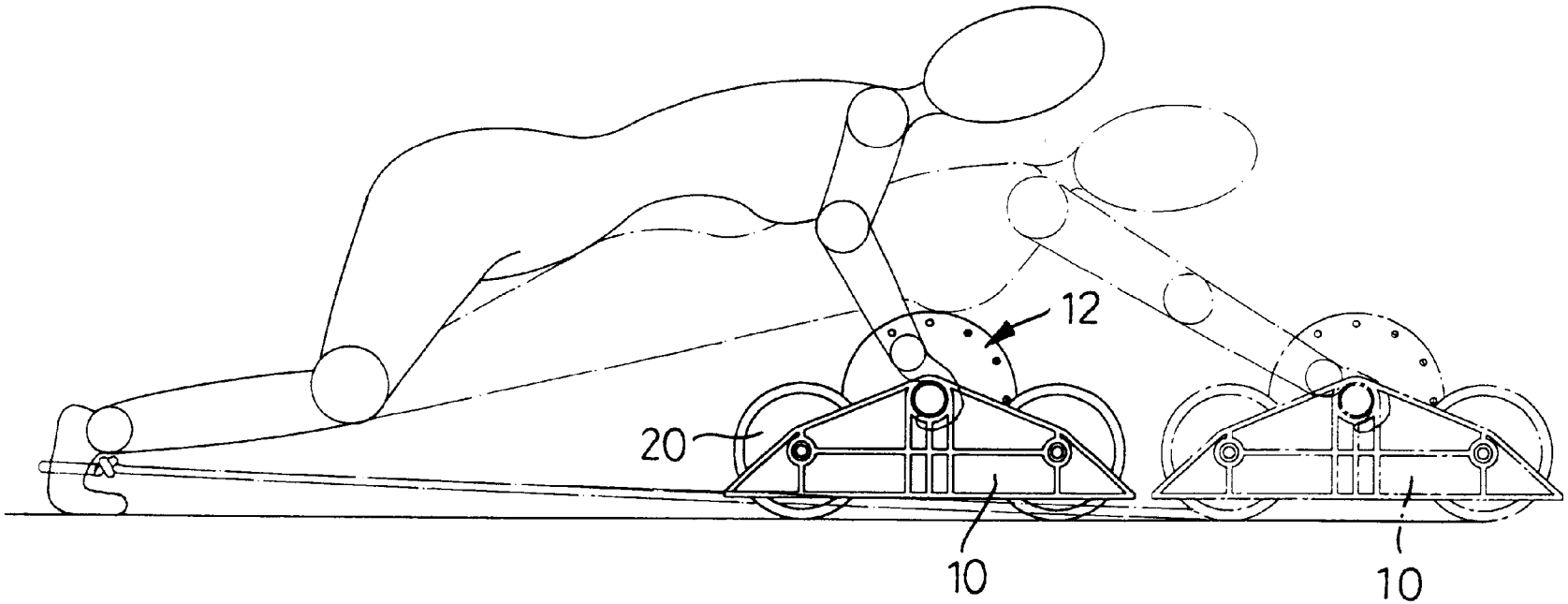
FIG. 4 is an operational side plan view of the roller exerciser with the damping assembly in FIG. 1.

With reference to FIGS. 1 and 2, a damping assembly in accordance with the present invention comprises a bracket

(10), a damping wheel (12), a torsion spring (15), at least one pair of rotating wheels (20) and a strap (30). The bracket (10) is substantially U-shaped. A main axle (16) is rotatably mounted in the bracket (10). The damping wheel (12) is mounted on the main axle (16). The damping wheel (12) is composed of a body (13) and a cover (14) secured to one side of the body (13). A sleeve (132) co-axially protrudes from the body (13) to be pressed on the main axle (16), such that the body (13) is secured on the main axle (16) and can rotate relative to the bracket (10).

The torsion spring (15) is mounted around the sleeve (132) with one end connected to the bracket (10) and the other end to the damping wheel (12). The end of the torsion spring (15) connected to the bracket (10) is inserted into a hole (102) defined in the bracket (10). When the damping wheel (12) rotates relative to the bracket (10), the torsion spring (15) tightens and generates a torsion force on the damping wheel (12). A lip (142) is integrally formed on one section of the edge of the cover (14) facing the body (13), so that a gap is formed between the body (13) and the cover (14) in the section where the lip (142) is not present. The end of the torsion spring (15) extends through the gap and is held in the hole (102).

At least one secondary axle (22) is rotatably mounted in the bracket (10) parallel to the main axle (16). A pair of rotating wheels (20) is mounted on each secondary axle (22). A cord (24) is attached to and wound around each rotating wheel (20) on one pair of rotating wheels (20). One end of each cord (24) is secured to the corresponding rotating wheel (20), and the other end is free. A grip is mounted on the free end of each cord (24). When the user pulls the cord (24), the corresponding rotating wheel (20) will be rotated relative to the bracket (10).

The strap (30) is connected between the damping wheel (12) and the secondary axle (22) with the rotating wheels (20) attached to the cords (24). One end of the strap (30) is secured to the body (13), and the strap (30) is wound around the body (13). The other end of the strap (30) is secured to the secondary axle (22) with the rotating wheels (20) connected to the cords (24). Because the strap (30) is connected to both the damping wheel (12) and the secondary axle (22), the damping wheel (12) and the rotating wheels (20) will rotate simultaneously. Two disks (222) are mounted on the secondary axle (22) connected to the strap (30) to abut each side of the strap (30) so that the alignment of the strap (30) wound on the secondary axle (22) is maintained with the strap (30) wound on the body (13).

A through hole (104) is defined in the bracket (10) through which each rotating wheel (20) extends. A handlebar (18) is mounted in the bracket (10). In practice, either the handlebar (18) extends through the main axle (16), or the handlebar (18) is, in fact, two handles (not numbered) attached to the bracket (10). A user can grip the ends of the handlebar (18) to control the bracket (10). Accordingly, the bracket (10) can be pushed to move along the floor.

With reference to FIGS. 1 to 4, a user can place his or her feet in the grips attached to the cords (24) and grip the handlebar (18). When the user extends his or her body, the bracket (10) will move along the floor and the cords (24) are pulled from the rotating wheels (20). The rotating wheels (20) and the secondary axle (22) rotate relative to the bracket (10). The secondary axle (22) pulls the strap (30) off of the damping wheel (12) and around the secondary axle (22), such that the damping wheel (12) will rotate with the rotating wheels (20). The rotation of the damping wheel (12) will tighten the torsion spring (15). This can provide a damping effect to the user. An exercising or a conditioning effect is provided.

When the user curves his or her body, the torsion spring (15) can provide a torsion force to rotate the damping wheel (12) in a reverse direction. This helps the user pull the bracket (10) back. The strap (30) and each cord (24) will be respectively wound around the damping wheel (12) and each corresponding rotating wheel (20).

Figure 5:
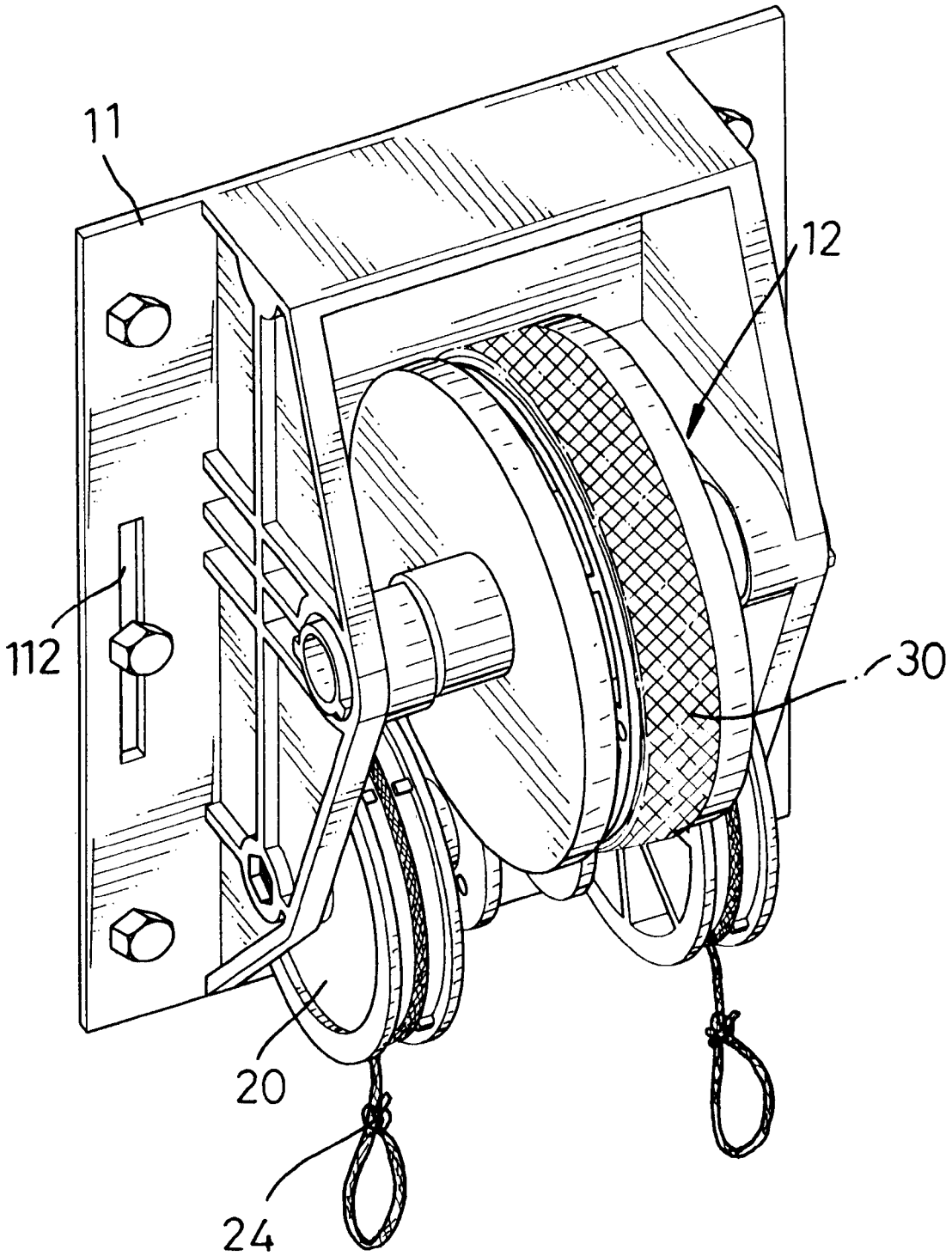
FIG. 5 is a perspective view of the damping assembly in FIG. 2 in a chest exerciser.
Figure 6:
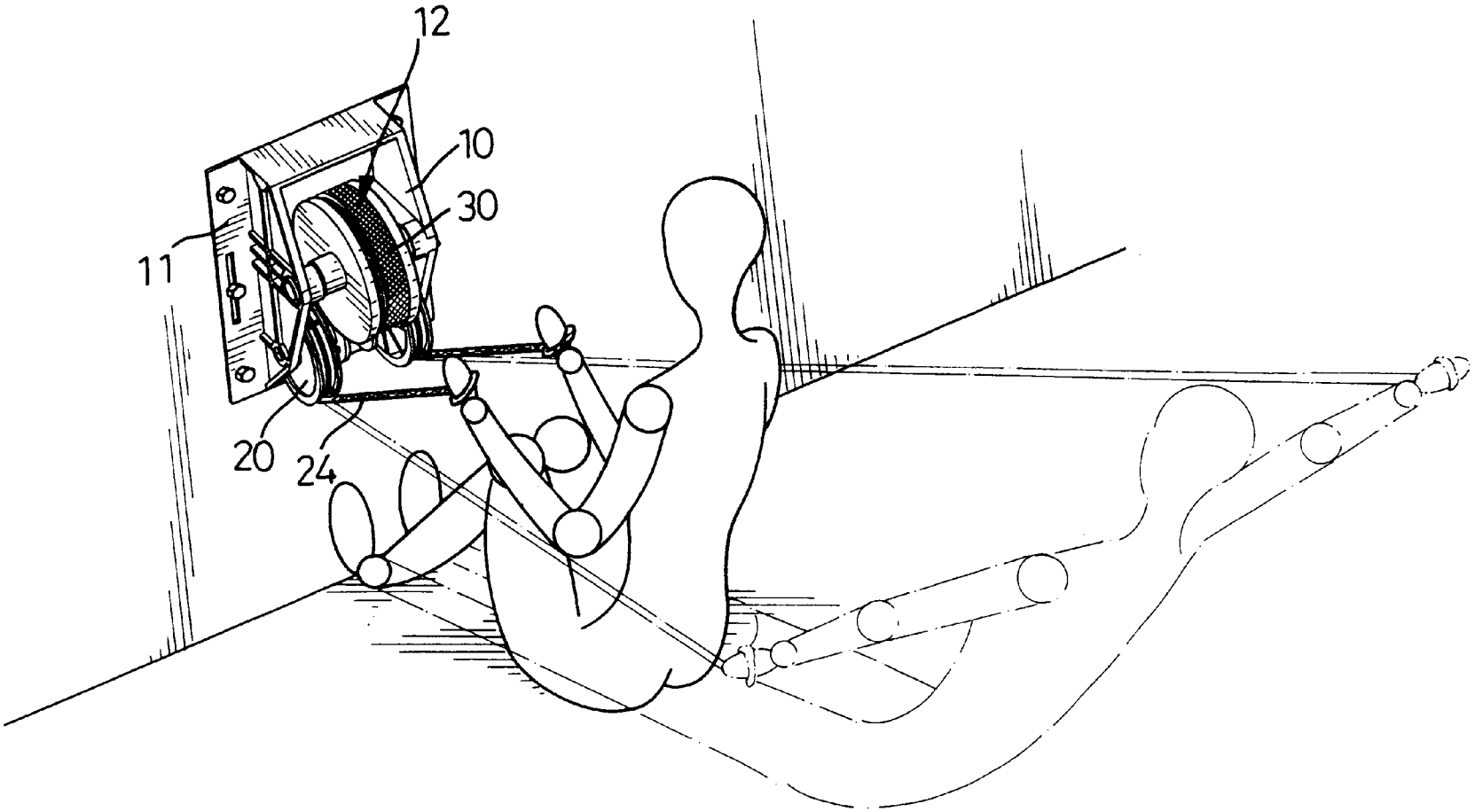
FIG. 6 is an operational perspective view of the chest exerciser with the damping assembly in FIG. 5.

With reference to FIGS. 2, 5 and 6, another embodiment of the damping assembly includes a wing (11) laterally extending from each side of the bracket (10). At least one through hole or slot (112) is defined in each wing (11). A fastener like a bolt extends through each through hole or slot (112) on the wing (11) to secure the bracket (10) to an object like the floor or the wall. Accordingly, the damping assembly can be used as a chest exerciser. A user can hold the grips attached to the cords (24) and pull the cords (24). The damping wheel (12) will rotate with the rotating wheels (20) by the transmission of the strap (30). The torsion spring (15) will tighten and provide a damping effect against the pull of the user. An exercising or conditioning effect to the chest of the user is provided.

Therefore, the damping assembly can be used with different types of exercisers. The use of the damping assembly becomes more versatile. In addition, the cost for manufacturing different types of exercisers is reduced.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed:

1. A damping assembly comprising:

a bracket;

a damping wheel rotatably mounted on the bracket;

a torsion spring mounted between the bracket and the damping wheel to provide a torsion force to the damping wheel;

at least one secondary axle rotatably mounted in the bracket;

a pair of rotating wheels mounted on each of the at least one secondary axle;

a cord wound around each rotating wheels on one of the at least secondary axle and having an end secured to the rotating wheel around which the cord winds;

a strap connected between the damping wheel and the secondary axle with the rotating wheels that are attached to the cords; and a grip operatively connected to the damping wheel so that a human user may experience a damping effect through the grip.

2. The damping assembly as claimed in claim 1, wherein a main axle is rotatably mounted in the bracket for the damping wheel mounted on the main axle.

3. The damping assembly as claimed in claim 2, wherein the damping wheel is composed of a body mounted on the main axle and a cover secured to one side of the body, wherein the strap is wound around the body and has one end secured to the body; and one end of the torsion spring is connected to the body.

4. The damping assembly as claimed in claim 3, wherein a sleeve co-axially extends from the body to be pressed onto the main axle; and the torsion spring is mounted around the sleeve.

5. The damping assembly as claimed in claim 3, wherein a hole is defined in the bracket to hold the other end of the torsion spring.

6. The damping assembly as claimed in claim 1, wherein a lip is integrally formed on a section of the edge of the cover facing the body; and a gap is defined between the body and the cover through which one end of the torsion spring extends.

7. The damping assembly as claimed in claim 1, wherein two disks are mounted on the secondary axle with the disk to abut each side of the strap.

8. The damping assembly as claimed in claim 1, wherein a through hole is defined in the bracket through which each rotating wheel extends.

9. The damping assembly as claimed in claim 8, wherein a handlebar is mounted in the bracket; and the grip is mounted on the free end of each cord.

10. The damping assembly as claimed in claim 9, wherein the handlebar extends through the main axle.

11. The damping assembly as claimed in claim 9, wherein the handlebar is two handles secured to the bracket.

12. The damping assembly as claimed in claim 1, wherein a wing laterally extends from each side of the bracket;

at least one through hole is defined in each wing through which a fastener extends.

13. The damping assembly as claimed in claim 12, wherein the grip is attached to a free end of each cord.

* * * * *